US011105554B2

(12) United States Patent
Funk

(10) Patent No.: US 11,105,554 B2
(45) Date of Patent: Aug. 31, 2021

(54) DRYING SYSTEM

(71) Applicant: Robert Michael Funk, Jersey City, NJ (US)

(72) Inventor: Robert Michael Funk, Jersey City, NJ (US)

(73) Assignee: Robert Michael Funk, Jersey City, NJ (US)

( * ) Notice: Subject to any disclaimer, the term of this patent is extended or adjusted under 35 U.S.C. 154(b) by 91 days.

(21) Appl. No.: 16/744,276

(22) Filed: Jan. 16, 2020

(65) Prior Publication Data

US 2021/0222950 A1 Jul. 22, 2021

(51) Int. Cl.

| | |
|---|---|
| ***F26B 3/30*** | (2006.01) |
| ***F26B 21/00*** | (2006.01) |
| ***F26B 9/02*** | (2006.01) |

(52) U.S. Cl.

CPC ..... *F26B 3/30* (2013.01); *F26B 9/02* (2013.01); *F26B 21/003* (2013.01)

(58) Field of Classification Search

CPC ..... F26B 3/30; F26B 9/02; F26B 21/003
USPC ..... 34/267
See application file for complete search history.

(56) References Cited

U.S. PATENT DOCUMENTS 1,672,326 A * 6/1928 Kobiolke ..... B27K 5/001 422/28
2,838,424 A * 6/1958 Depew ..... B27K 3/12 427/297
3,394,462 A * 7/1968 Bondurant ..... F26B 3/205 34/339
6,688,018 B2 * 2/2004 Soucy ..... F26B 23/002 34/68
7,739,829 B2 * 6/2010 Chen ..... A01M 13/003 43/132.1
2004/0031282 A1 * 2/2004 Kopko ..... F28D 5/00 62/271
2010/0115785 A1 * 5/2010 Ben-Shmuel ..... F26B 3/347 34/260

FOREIGN PATENT DOCUMENTS

WO WO-2006028572 A3 * 5/2007 ..... A01M 13/003

* cited by examiner

*Primary Examiner* — Stephen M Gravini
(74) *Attorney, Agent, or Firm* — Dragon Sun Law Firm, PC; Jinggao Li, Esq.

(57) ABSTRACT

A drying system for drying an agriculture product is disclosed. The drying system includes an enclosure having one or more wall structures and defining a chamber for receiving and storing the agricultural product. Each wall structure includes an inner wall having a plurality of wood panels and an outer wall. Each wood panel is a treated wood panel and is adapted to absorb moisture from an air circulating inside the chamber. Each wood panel is treated with a solution of calcium chloride to enhance a moisture absorbing capacity. The outer wall is disposed substantially parallel and spaced apart from the inner wall and defines a gap therebetween. The enclosure further includes one or more moisture absorbing materials disposed inside the gap to absorb moisture received from the inner wall.

11 Claims, 3 Drawing Sheets

DRYING SYSTEM

TECHNICAL FIELD

The present disclosure relates, generally, to a drying system. More particularly, the present disclosure pertains to a drying system having one or more inner walls made of a plurality of treated wood panels and suitable for drying agricultural products.

BACKGROUND

An agriculture product like tropical hardwood of hemps, delicate herbs, spices, mushrooms and flowers include moisture making them susceptible to biological agents like fungus, bacteria, insects and molds. To prevent the biological and chemical contamination of the agriculture products, drying of the agricultural products becomes important. Currently, various type of kilns is utilized. However, the existing kilns do not remove the moisture content from the agricultural products efficiently and effectively.

SUMMARY

According to an aspect of the disclosure a drying system for drying an agriculture product is disclosed. The drying system includes an enclosure having one or more wall structures and defining a chamber for receiving and storing the agricultural product. Each wall structure includes an inner wall having a plurality of wood panels and an outer wall. Each wood panel is a treated wood panel and is adapted to absorb moisture from an air circulating inside the chamber. Each wood panel is treated with a solution of calcium chloride to enhance a moisture absorbing capacity. The outer wall is disposed substantially parallel and spaced apart from the inner wall and defines a gap therebetween. The enclosure further includes one or more moisture absorbing materials disposed inside the gap to absorb moisture received from the inner wall.

In an embodiment, the solution includes 95 percent of the calcium chloride by weight.

According to yet another embodiment, the plurality of wood panels is a plurality of inner wood panels and the outer wall includes a plurality of outer wood panels. The plurality of outer wood panels is untreated wood panels.

In an embodiment, the drying system further includes one or more heating units disposed inside the chamber to facilitate a heating of the agricultural product disposed inside the chamber.

In an embodiment, the one or more heating units include one or more infrared heaters.

In another embodiment, the drying system further includes a controller for controlling the one or more heating unit for controlling a temperature of air inside the chamber.

In one embodiment, the drying system further includes a plurality of fans for facilitating a circulation of air inside the chamber.

In one embodiment, the plurality of fans includes an intake fan for controlling a flow of air inside the chamber from an ambient and one or more circulation fans for facilitating a circulation of air inside the chamber.

In one embodiment, the drying system further includes a controller for controlling one or more of the plurality of fans for controlling at least one of a temperature of air or a humidity of air inside the chamber.

In one embodiment, the one or more moisture absorbing materials includes a plurality of fibers treated with a solution of calcium chloride.

In one embodiment, the one or more moisture absorbing materials includes a mixture of sawdust and calcium chloride.

For a more complete understanding of the present invention, reference is made to the following detailed description and accompanying drawings. In the drawing, like reference characters refer to like parts throughout the views in which.

DETAILED DESCRIPTION

Figure 1:
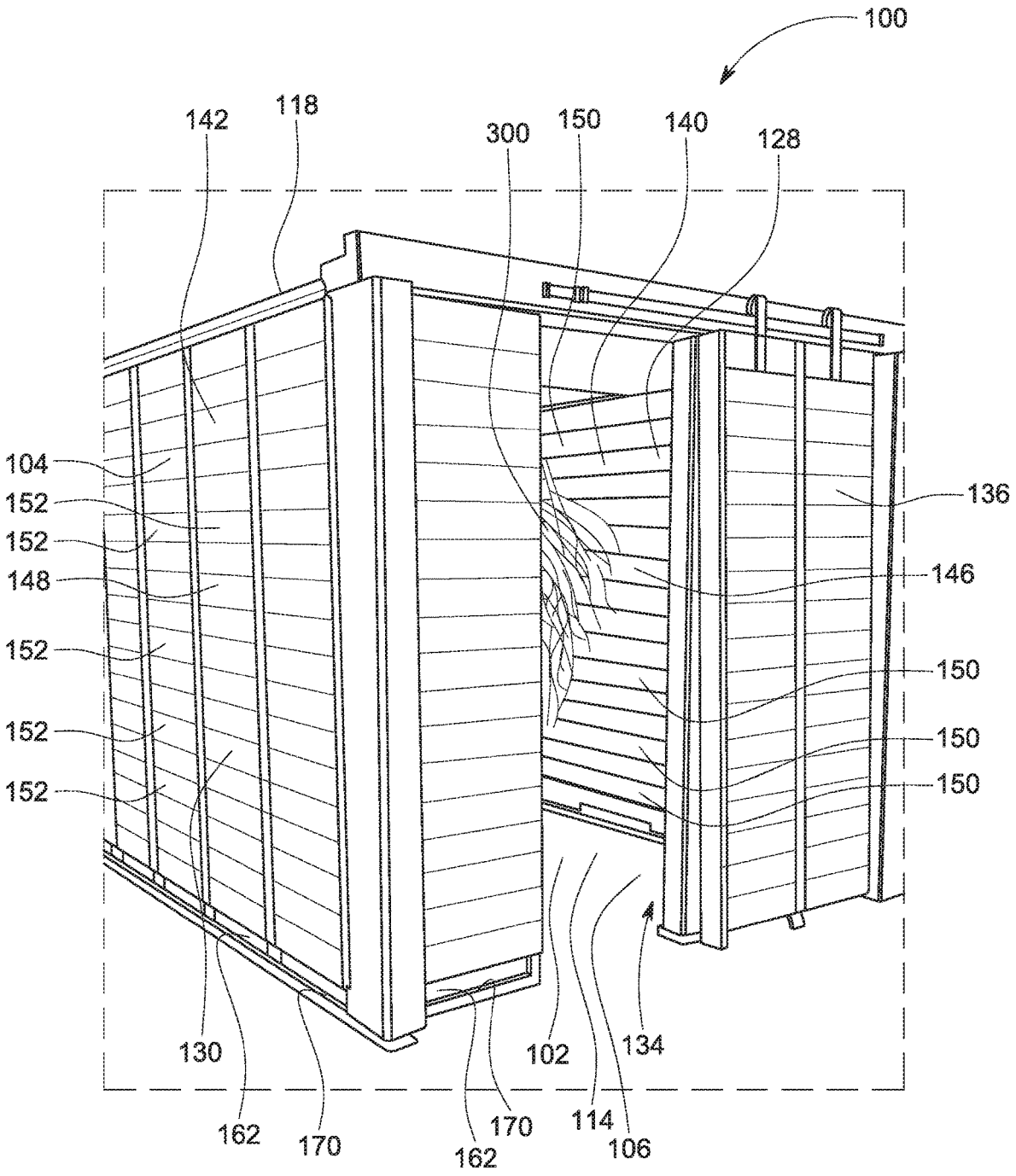
FIG. 1 illustrates a perspective view of a drying system including agriculture product, in accordance with an embodiment of the disclosure.
Figure 2:
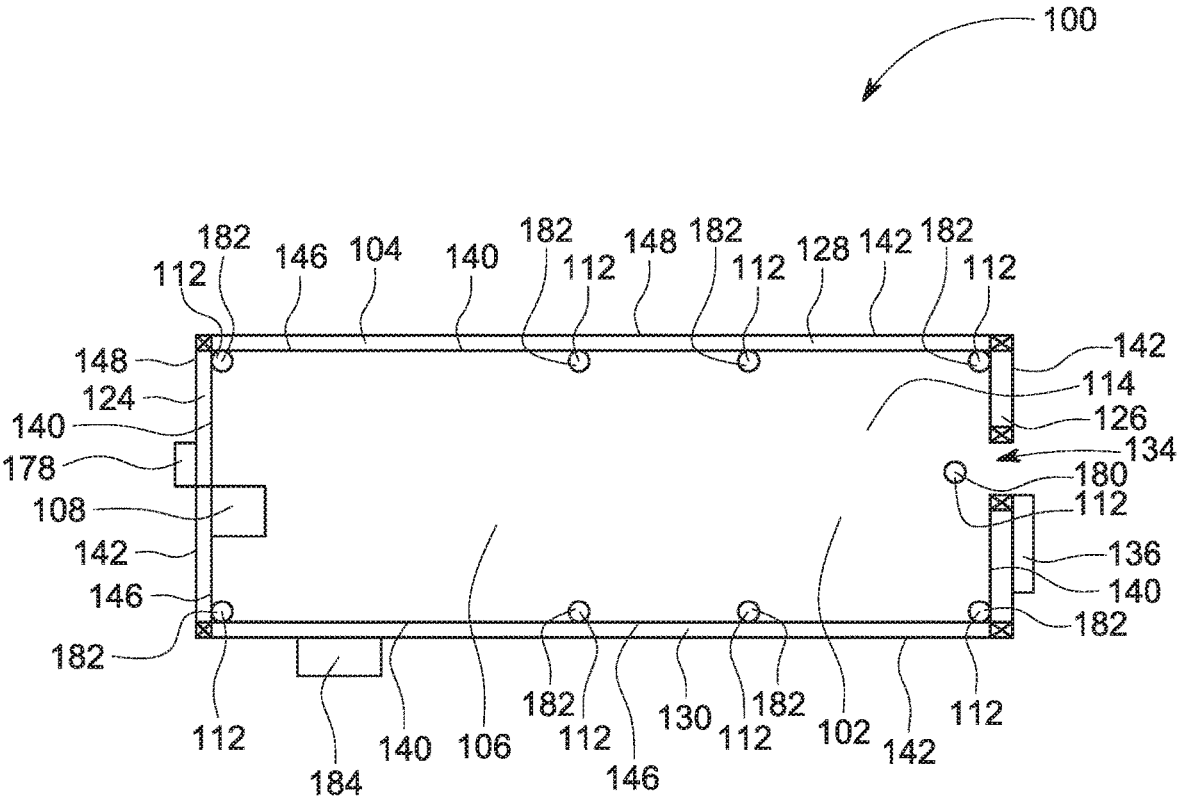
FIG. 2 illustrates a top view of the drying system with a roof structure detached, in accordance with an embodiment of the disclosure.
Figure 3:
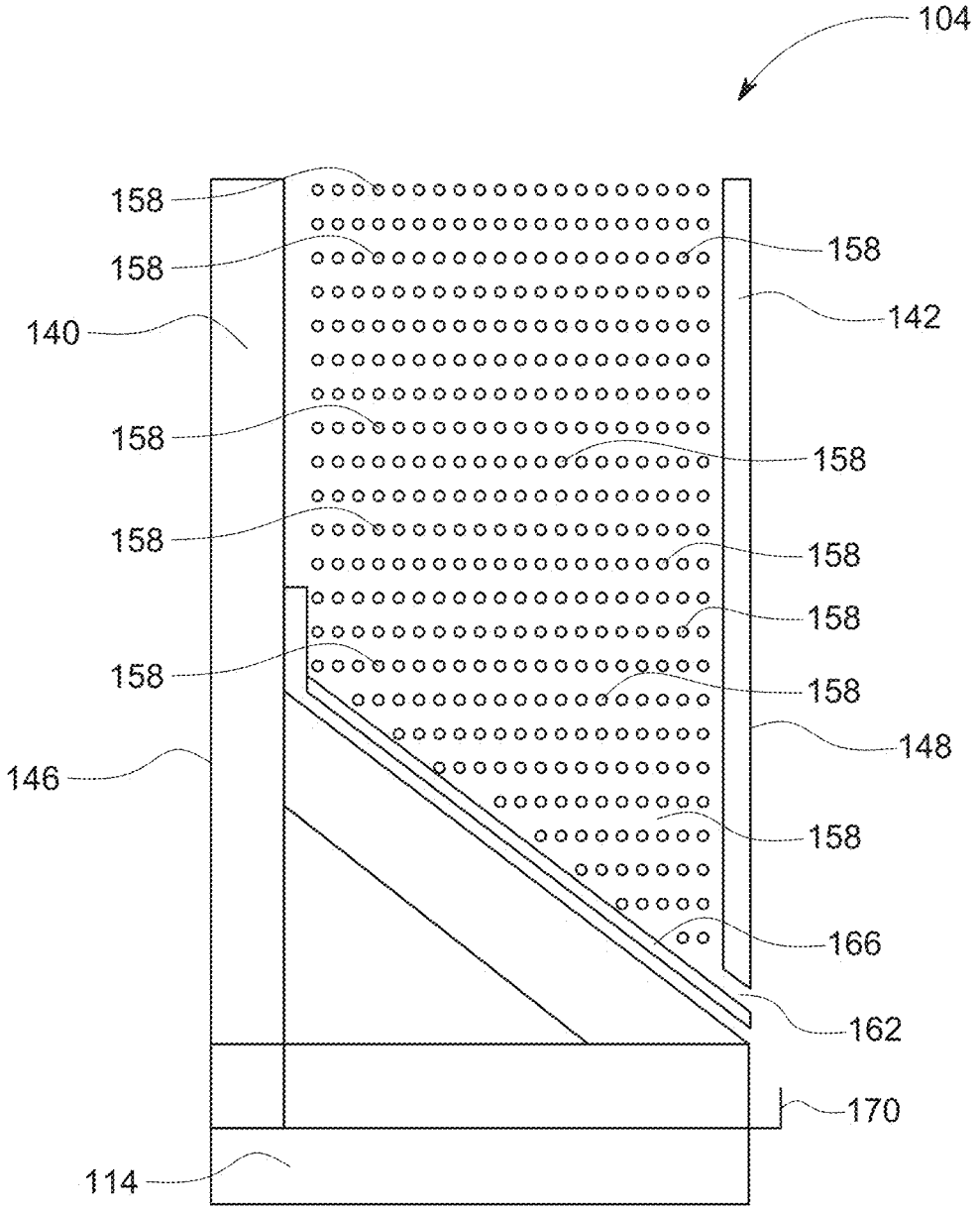
FIG. 3 illustrates a wall structure including an inner wall and an outer wall of the drying system, in accordance with an embodiment of the disclosure.

Referring to FIG. 1, a drying system 100 suitable for drying or reducing the moisture content in an agriculture product 300 is shown. The drying system 100 includes an enclosure 102 having one or more wall structures 104 defining a chamber 106 for receiving the agricultural product 300, one or more heating units 108 disposed inside the chamber 106 for heating the agricultural product 300 disposed inside the enclosure 102, and a plurality of fans 112 disposed for facilitating a circulation of air inside the chamber 106. As shown in FIG. 1, the enclosure 102 may be a cuboidal structure including a base 114 defining a floor of the enclosure 102, and the one or more wall structures 104 extending upwardly from the base 114, and a roof structure 118 disposed spaced apart from the base 114 and abutting the upper ends of the one or more wall structures 104, for example, a first wall structure 124, a second wall structure 126, a third wall structure 128, and a fourth wall structure 130. Although, the enclosure 102 is contemplated as the cuboidal structure, it may be appreciated that the enclosure 102 may include any other suitable shape, such as, but not limited to, a cylindrical structure, or any other suitable structure known in the art. Further, the one or more wall structures 104 may define an access opening 134 to facilitate an entry or exit of the agricultural products 300, and a gate 136 for selectively covering the access opening 134.

Further, each of the wall structure 104 includes an inner wall 140 and an outer wall 142 disposed spaced apart from the inner wall 140 and substantially parallel to the inner wall 140. In this manner, a gap 'G' is defined between the inner wall 140 and the outer wall 142. The inner wall 140 defines an interior surface 146 of the enclosure 102, while the outer wall 142 defines an exterior surface 148 of the enclosure 102. Accordingly, the one or more outer walls 142 surround the one or more inner walls 140. Also, the inner wall 140 includes a plurality of wood panels 150 (hereinafter referred to as the plurality of inner wood panels 150) that are engaged with each other to form the inner wall 140. As an example, the plurality of inner wood panels 150 may be made up of poplar, cedar or any another suitable wooden material known in the art. Similarly, the outer wall 142 may include a plurality of wood panels 152 (hereinafter referred to as the plurality of outer wood panels 152) that are engaged/ coupled/attached together to form the outer wall 142. The inner wood panels 150 are adapted to interact with the air circulating inside the chamber 106 and facilitate an absorption of the moisture from the air. In an implementation, to achieve an effective moisture absorption and transfer, the inner wood panels 150 are treated wood panels, while the outer wood panels 152 are untreated wood panels. The inner wood panels 150 are treated with a solution of calcium chloride. The treatment process increases the moisture absorption capacity of the inner wood panels 150 by facilitating the infusion of calcium chloride in the inner wood panels 150.

The process of treatment for treating the inner wood panel 150 is now explained. For treating the inner wood panels 150, a solution of calcium chloride is prepared. For so doing, the calcium chloride in either solid form or powdered form is dissolved in water. In an embodiment, the solution includes approximately 95 percent of the calcium chloride. For example, the solution includes a proportion of 1 pound of the calcium chloride dissolved in 1 gallon of the water. The calcium chloride dissolves in the water solvent to produce an aqua complex $[Ca(H_2O)_6]^{2-}$ and Chloride (Cl). After preparing the solution, the inner wood panels 150 are submerged in the solution from 24 hours to 36 hours at a predefined temperature. In an embodiment, the predefined temperature is approximately 120 degrees Fahrenheit. In this manner, the calcium chloride is infused inside each inner wood panel 150. Subsequent to treatment of the inner wood panels 150 with the solution, the inner wood panels 150 are removed from the solution and dried for predefined time duration. In this manner, the inner wood panels 150 are treated before joining with each other to for the inner wall 140.

Moreover, the enclosure 102 includes one or more moisture absorbing materials 158 disposed inside the gap 'G' defined between the inner wall 140 and the outer wall 142. In an embodiment, the moisture absorbing material 158 may include a plurality of fibers treated with a solution of calcium chloride. The solution of the calcium chloride is prepared by using water as a solvent and may include 95 percent calcium chloride by weight. In certain implementations, the moisture absorbing material 158 may include a mixture of saw dust and calcium chloride. For example, to fill 1 cubic foot of gap 'G' the mixture may include 12 pound of 95 percent calcium chloride by weight mixed with a medium size sawdust having moisture content of approximately 20 percent. In certain scenario, the moisture absorbing materials 158 may include only the powdered calcium chloride. The moisture absorbing material 158 is adapted to absorb the moisture from the plurality of inner wood panels 150. In an embodiment, the moisture absorbing material 158 transfers a part of the moisture received from the inner wood panels 150 to the outer wood panels 152 which subsequently gets transferred or evaporated to an ambient. Moreover, a part of the moisture absorbed by the moisture absorbing material 158 gets converted into the water that drains out to the ambient through one or more outlets 162 defined by the outer wall 142 and disposed proximate to the base 114. In an embodiment, to facilitate an effective draining of water from the gap 'G', an inclined plate 166 is disposed inside the gap 'G' that extends upwardly and at an inclination relative to the base 114. Additionally, the enclosure 102 may include a gutter 170 attached to the exterior surface 148 of the outer wall 142 and position below the outlet 162 to receive and store the water exiting the gap 'G'. Accordingly, the gutter 170 prevents any spillage of water in the vicinity of the drying system 100.

Further, the one or more heating units 108 may be disposed inside the chamber 106 and mounted to the base 114 or proximate to the base 114. Although, mounting of the heating units 108 with the base 114 or closer to the base 114 is contemplated, it may be envisioned that the heating units 108 may be suitably disposed anywhere inside the chamber 106. The heating units 108 are adapted to heat the agricultural product 300 located inside the chamber 106 and/or the air circulating inside the chamber 106. In an embodiment, the heating unit 108 may be an infrared heater. However, it may be appreciated that the heating unit 108 may be any other suitable heater adapted to facilitate the heating of the agricultural products 300 and/or the air circulating inside the chamber 106.

Further, in an embodiment, the plurality of fans 112 is disposed inside the chamber 106 for facilitating a circulation of air inside the chamber 106. The plurality of fans 112 may include an intake fan 178 to facilitate intake of air into the chamber 106 form the ambient, an exhaust fan 180 adapted to facilitate an exit of air from the chamber 106, and one or more circulation fans 182 for circulating air present inside the chamber for uniform heating of the air, and thus agricultural product 300. In an embodiment, the exhaust fan 180 is disposed proximal to the access opening 134 so as to facilitate the exit of air from the chamber 106 through the access opening 134. In an embodiment, a speed of each of the plurality of fans 112 may be adaptively controlled to control the circulation, intake, and exhaust of air.

Further, the drying system 100 may include a controller 184 for controlling a temperature and/or a humidity inside the chamber 106. In an embodiment, the drying system 100 may include one or more sensors, such as, but not limited to, a temperature sensor, a humidity sensor, etc., to monitor the temperature and the humidity inside the chamber 106. The controller 184 may control the one or more heating units 108 and/or the plurality of fans 112 for controlling the temperature of air and/or moisture (i.e. the humidity of air) inside the chamber 106 based on the inputs from the one or more sensors. By controlling the temperature of air and/or humidity of air inside the chamber 106, the controller 184 may control a temperature and therefore moisture content of the agricultural product 300. In an embodiment, the controller 184 may shut down the one or more heating units 108 and the plurality of fans 112 in response to a detection of an emergency condition. In an implementation, the emergency condition may correspond to a detection of smoke inside the chamber. In certain scenario, the emergency condition may correspond to detection of a temperature above a threshold temperature.

An operation of the drying system 100 are now explained. At first, the agriculture product 300 to be dried is placed inside the enclosure 102. Thereafter, the one or more heating units 108 and the plurality of fans 112 are switched on to heat air inside the chamber 106 as well as the agricultural product 300. As the air and the agricultural product 300 is heated, the moisture present in the agricultural product 300 is transferred/evaporated to the air flowing/circulating inside the chamber 106. Subsequently, the air interacts with the inner wood panels 150 and transfer at least a part of the moisture to the inner wood panels 150. As the inner wood panels 150 are infused/treated panels having calcium chloride, the inner wood panels 150 absorb the moisture from the air effectively. The moisture absorbed by the inner wood panels 150 is absorbed by the moisture absorbing material 158 that transfers a part of the absorbed moisture to the ambient through the outer wood panels 152, while the remaining absorbed moisture may be converted into liquid water that drains out of the gap 'G' through the one or more outlets 162. In this manner, the drying system 100 effectively and efficiently removes moisture from the agricultural product 300 to the ambient. Further, the drying system 100 facilitates in reducing the moisture content of the agricultural product 300 in a relatively fast manner.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

LIST OF ELEMENTS

100 drying system
102 enclosure
104 wall structure
106 chamber
108 heating unit
112 plurality of fans
114 base
118 roof structure
124 first wall structure
126 second wall structure
128 third wall structure
130 fourth wall structure
134 access opening
136 gate
140 inner wall
142 outer wall
146 interior surface
148 exterior surface
150 inner wood panel
152 outer wood panel
158 moisture absorbing material
162 outlet
166 inclined plate
170 gutter
178 intake fan
180 exhaust fan
182 circulation fan
184 controller
300 agriculture product

What is claimed is:

1. A drying system for drying an agriculture product, the drying system comprising:
- an enclosure having one or more wall structures and defining a chamber for receiving and storing the agricultural product, each wall structure including
  - an inner wall having a plurality of wood panels, each wood panel being a treated wood panel and is adapted to absorb moisture from an air circulating inside the chamber, wherein each wood panel is treated with a solution of calcium chloride to enhance a moisture absorbing capacity;
  - an outer wall disposed substantially parallel and spaced apart from the inner wall and defining a gap therebetween; and
  - one or more moisture absorbing materials disposed inside the gap to absorb moisture received from the inner wall.

2. The drying system of claim 1, wherein the solution includes 95 percent of the calcium chloride by weight.

3. The drying system of claim 1, wherein the plurality of wood panels is a plurality of inner wood panels and the outer wall includes a plurality of outer wood panels, wherein the plurality of outer wood panels is untreated wood panels.

4. The drying system of claim 1 further including one or more heating units disposed inside the chamber to facilitate a heating of the agricultural product disposed inside the chamber.

5. The drying system of claim 4, wherein the one or more heating units include one or more infrared heaters.

6. The drying system of claim 4 further including a controller for controlling the one or more heating unit for controlling a temperature of air inside the chamber.

7. The drying system of claim 1 further including a plurality of fans for facilitating a circulation of air inside the chamber.

8. The drying system of claim 7, wherein the plurality of fans includes an intake fan for controlling a flow of air inside the chamber from an ambient and one or more circulation fans for facilitating a circulation of air inside the chamber.

9. The drying system of claim 1 further including a controller for controlling one or more of the plurality of fans for controlling at least one of a temperature of air or a humidity of air inside the chamber.

10. The drying system of claim 1, wherein the one or more moisture absorbing materials includes a plurality of fibers treated with a solution of calcium chloride.

11. The drying system of claim 1, wherein the one or more moisture absorbing materials includes a mixture of sawdust and calcium chloride.

* * * * *